United States Patent [19]

Goodman et al.

[11] Patent Number: 5,037,331

[45] Date of Patent: Aug. 6, 1991

[54] SHIELDED INTERFACE CONNECTOR

[75] Inventors: David S. Goodman, Mission Viejo; Edward Rudoy, Woodland Hills, both of Calif.

[73] Assignee: ITT Corporation, New York, N.Y.

[21] Appl. No.: 413,160

[22] Filed: Sep. 27, 1989

[51] Int. Cl.[5] ..... H01R 13/658

[52] U.S. Cl. ..... 439/607; 439/108

[58] Field of Search ..... 439/607–610, 439/92, 95, 108, 347, 906

[56] References Cited

U.S. PATENT DOCUMENTS

| | | | |
|---|---|---|---|
| 4,265,506 | 5/1981 | Hollyday | 339/147 |
| 4,398,780 | 8/1983 | Novotny et al. | 339/49 |
| 4,512,618 | 4/1985 | Kumar | 339/14 |
| 4,521,062 | 6/1985 | Kurbikoff et al. | 339/14 |
| 4,582,384 | 4/1986 | Frantz et al. | 339/143 |
| 4,585,292 | 4/1986 | Frantz et al. | 339/143 |
| 4,678,256 | 7/1987 | Nishino et al. | 439/347 |
| 4,689,723 | 8/1987 | Myers et al. | 361/424 |
| 4,708,412 | 11/1987 | Himes, Jr. et al. | 439/95 |
| 4,718,866 | 1/1988 | Yamaguchi | 439/607 |
| 4,786,260 | 11/1988 | Spaulding | 439/607 |
| 4,789,357 | 12/1988 | Yamaguchi et al. | 439/607 |
| 4,808,125 | 2/1989 | Waters et al. | 439/607 |
| 4,822,303 | 4/1989 | Nakamura et al. | 439/607 |
| 4,902,242 | 2/1990 | Davis et al. | 439/607 X |

*Primary Examiner*—Steven C. Bishop

*Attorney, Agent, or Firm*—Thomas L. Peterson

[57] ABSTRACT

A connector is provided, of the type that includes a largely insulative insert device (14) that fits closely into a metal shell (24), and wherein the metal shell fits into a diecast housing (32) that can be tightly clamped in place, wherein the insert device and shell are separately held to the housing. The housing has a vertical hole (34) for receiving the insert, and has horizontally-opening slots (46, 48) at opposite ends of the hole. The shell has a casing portion with a vertical hole (26) that closely receives the insert, and has a pair of largely horizontal flange portions (42, 44) that fit into the slots in the housing, until the holes in the housing and shell are aligned so the insert device can be received in both of them. The flange portions are bent in a largely wave-like manner, to provide good electrical connection with the walls of the slots in the housing.

8 Claims, 3 Drawing Sheets

FIG. 1
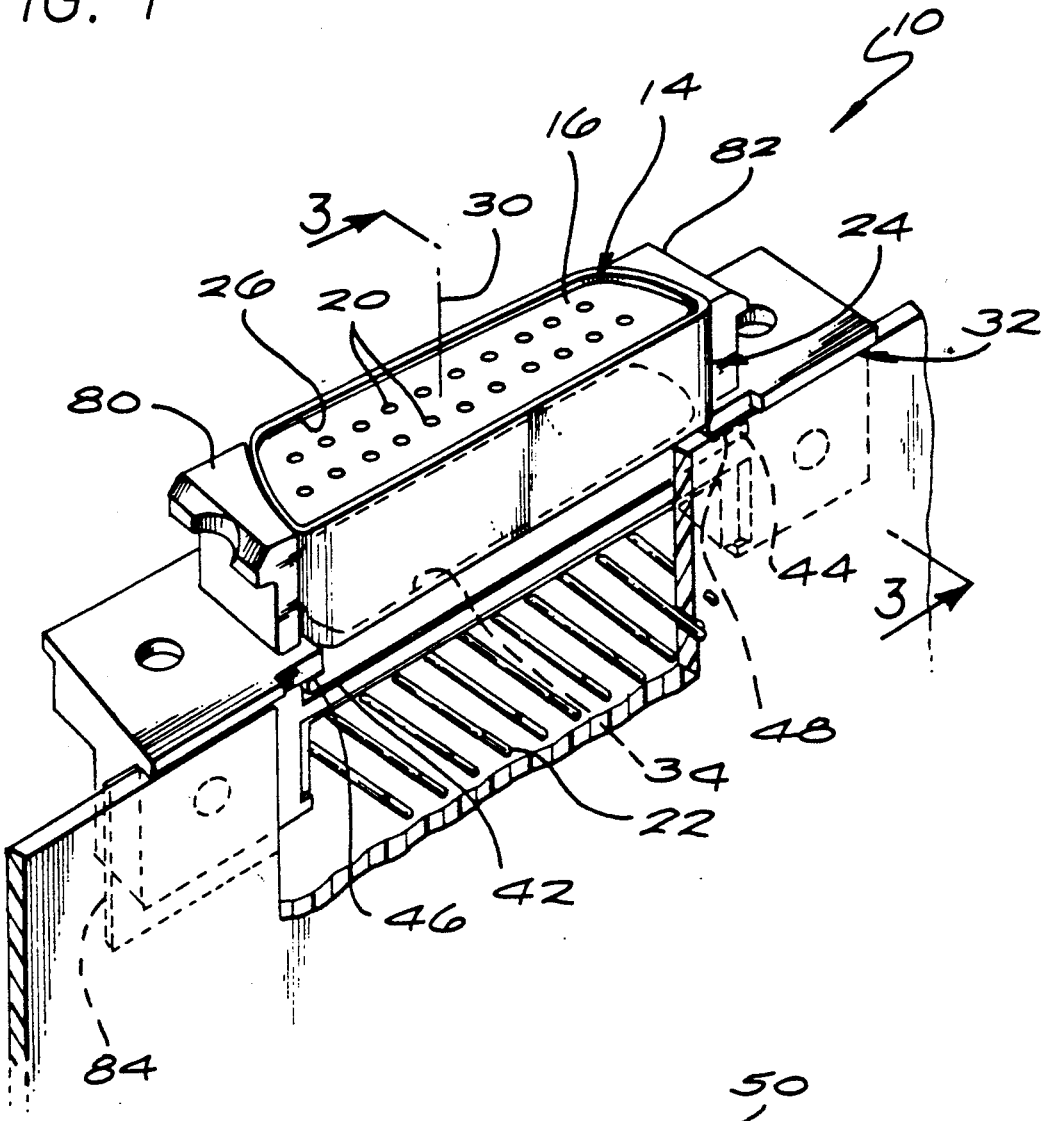
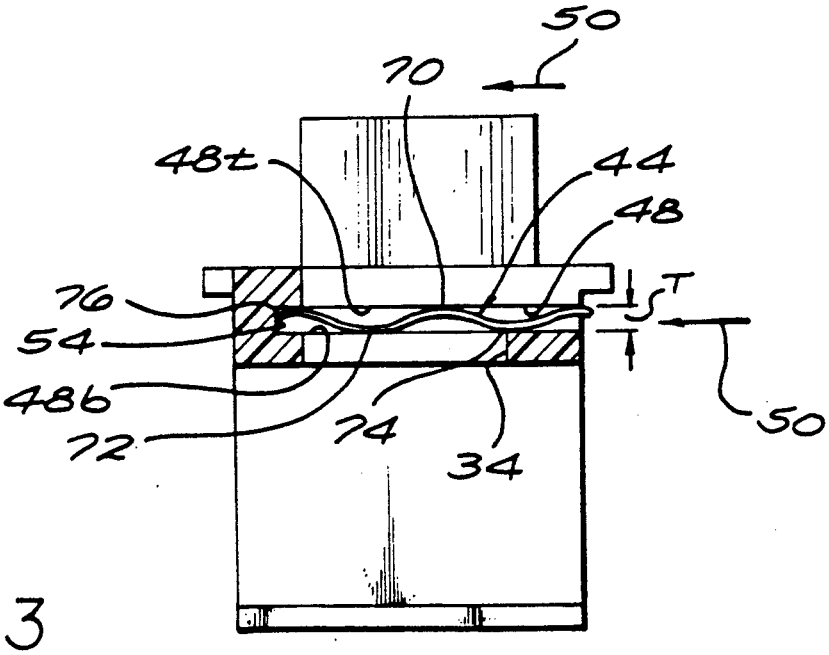
FIG. 3

FIG. 4
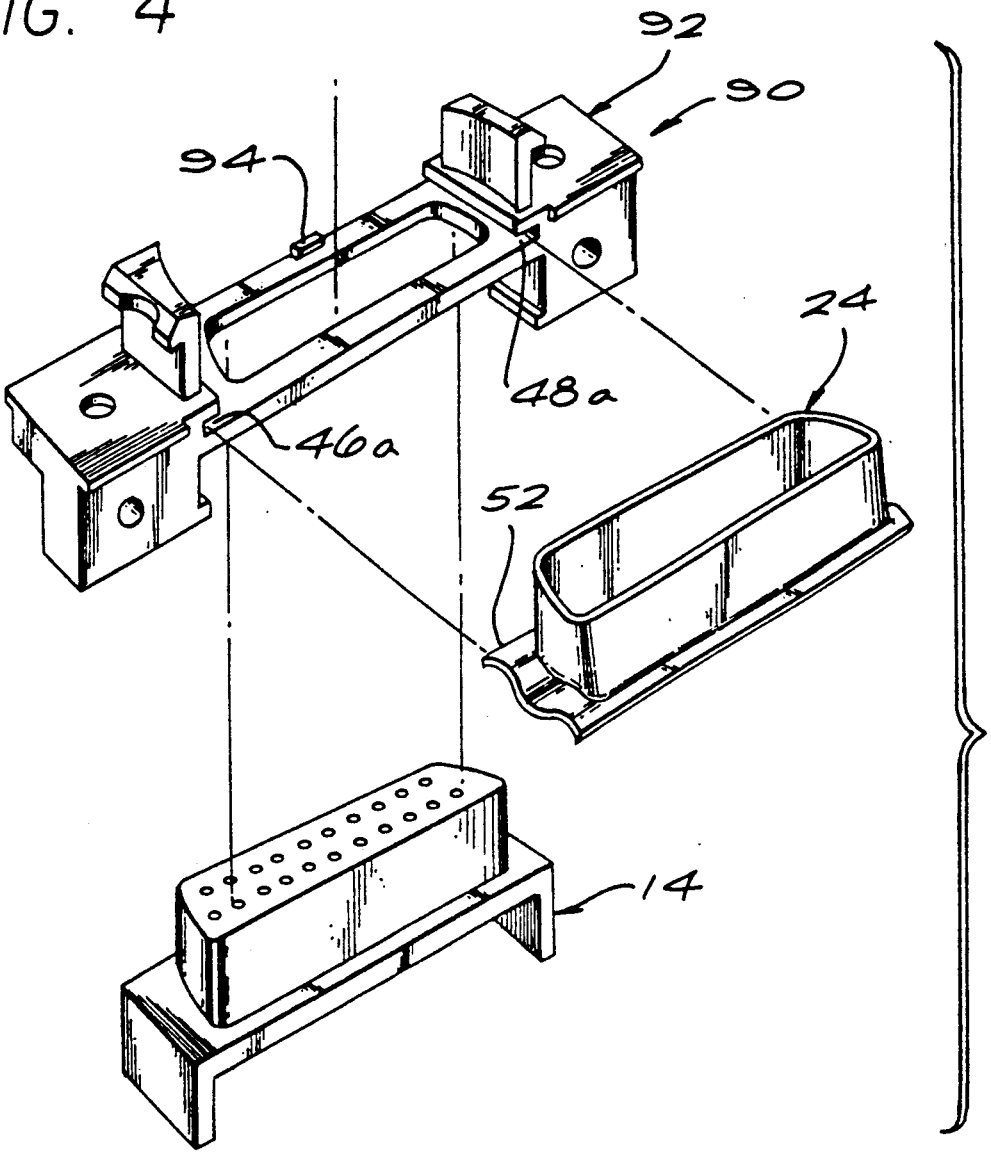
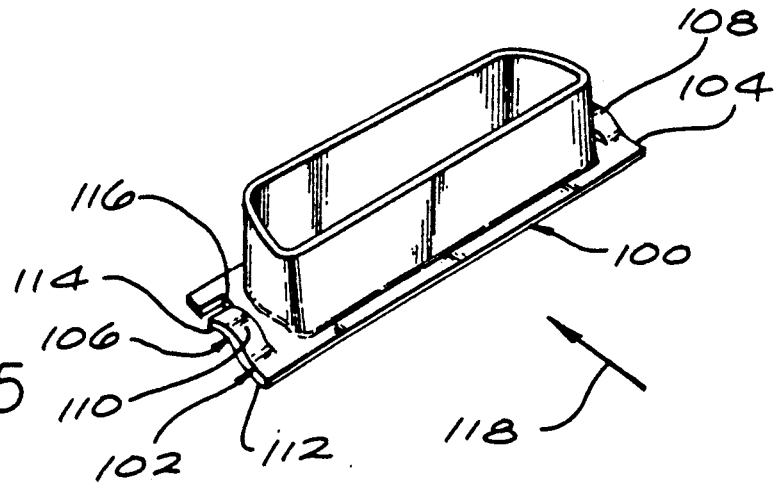
FIG. 5

SHIELDED INTERFACE CONNECTOR

BACKGROUND OF THE INVENTION

One type of connector includes a drawn sheet metal shell that closely receives an insert device which includes an insulative holder and multiple contacts therein. The shell is itself received in a housing of thick metal, such as a diecast housing, which can withstand large forces encountered when tightly clamped to another connector. Waters, et al. U.S. Pat. No. 4,808,125, describes a connector of this type. In that connector, the shell and insert are both installed by moving them vertically up into a hole in the housing, and with the insert device and shell separately held to the walls of the housing hole. A connector of the type that included a shell and a separate diecast or other thick metal housing to hold an insert, which divided the holding of the insert and shell, with good electrical connection between the shell and housing, could enable a connector to be constructed with highly reliable grounding of the shell to the housing.

SUMMARY OF THE INVENTION

In accordance with one embodiment of the present invention, a connector is provided, of the type that includes a thin metal shell that holds an insert device, and a thicker metal housing that holds the shell, which facilitates assembly. The housing, which may be a diecast metal housing, has a vertical opening for receiving the insert device, and has a pair of largely horizontally-opening slots lying at opposite ends of the vertical opening. The shell has opposite flange portions that can be slid horizontally into the housing, until a vertical hole in the shell is aligned with the vertical hole in the housing. The insert device can then be inserted up through the holes in the shell and housing to its final position. The opposite flange portions are formed to make good electrical contact with the slot walls.

The novel features of the invention are set forth with particularity in the appended claims. The invention will be best understood from the following description when read in conjunction with the accompanying drawings.

BRIEF DESCRIPTION OF THE DRAWINGS

FIG. 1 is an isometric view of a connector constructed in accordance with the present invention, shown mounted on a circuit board.

FIG. 3 is a view taken on the line 3—3 of FIG. 1, but showing only a flange end portion of the shell.

FIG. 4 is an exploded isometric view of a connector constructed in accordance with another embodiment of the invention.

FIG. 5 is an isometric view of a connector shell constructed in accordance with another embodiment of the invention.

DESCRIPTION OF THE PREFERRED EMBODIMENTS

Figure 2:
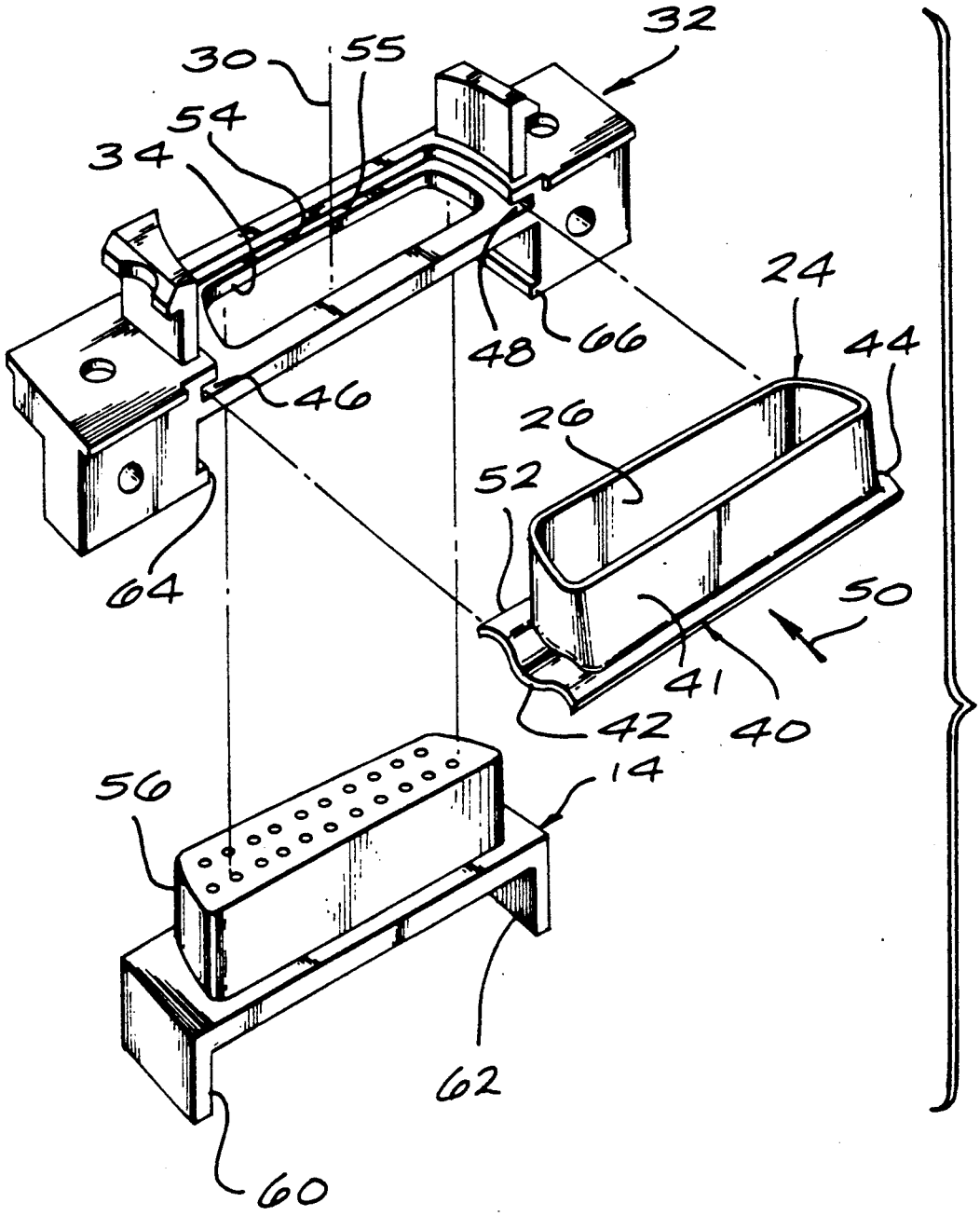
FIG. 2 is an exploded perspective view of the connector of FIG. 1.

FIG. 1 illustrates a connector 10 shown mounted on a circuit board 12. The connector includes an insert device 14 consisting of an insulative holder 16 and multiple contacts 20 that lie therein and that have lower ends 22 connected to plated-through holes of the circuit board. The upper part of the insert device is closely received in a drawn sheet metal shell 24, in a shell hole 26 that lies on an axis 30. The shell itself is captured in a housing 32 which has a hole 34 lying on the same axis 30, and through which the insert device 14 can pass. In the figures, the circuit board 12 is illustrated as lying in a vertical plane and the shell hole axis 30 is shown as vertical, and to facilitate description, certain parts will be described as extending vertically or horizontal; however, it is understood that such descriptions are only to aid in understanding these particular embodiments, and do not limit the actual orientations in which the parts may be used.

As shown in FIG. 2, the shell 24 is not designed to be received through the housing hole 34, but has a flange 40 surrounding a casing portion 41. The flange has opposite end portions 42, 44 that are designed to be received in slots 46, 48 in the housing 32. In assembling the connector, the shell 24 is first slid in an insert direction 50 so its flange end portions 42, 44 slide into the housing slots 46, 48. Such inward sliding continues until one side portion 52 of the flange abuts a limit wall 54 on the housing that lies in a side slot 55. At such abutment, the holes 26, 34 in the shell and in the housing are aligned. The insert device 14 is then moved upwardly along the axis 30 until its upper portion 56 passes through the housing hole 34 and into the shell casing hole 26 where the insert is closely received. The insert device includes a pair of lower legs 60, 62 that slightly deflect to pass by retainers 64, 66 on the housing, and which are afterwards held from downward movement by the retainers.

Each flange end portion 42, 44 is bent in a wave-like form with at least one top location 70 and two bottom locations 72, 74 to provide good contact with the top and bottom walls such as **48*t* and 48*b* (FIG. 3) of a slot. Each slot such as 48 has a limited thickness T. When uncompressed, the distance between top and bottom locations 70, 72, 74 of the flange is greater than the slot width T. Thus, the flange is compressed, to make good electrical contact with the walls of the housing slot. The upper surface of each flange portion such as 44 varies in height along the insert direction 50, which facilitates insertion because initially only a side edge 76** of the flange is inserted into a slot. Other approaches can be used to connect the flange portions to the slot walls, such as separate devices that fit into the slots. However, the wave-like formed flanges are rugged (for the thin metal used in the shell), avoid the expense of handling additional parts, and provide reliable grounding because of interlatching between the shell and housing.

Referring again to FIG. 1, the connector is designed to be mated to another connector, not shown, which is tightly connected to the housing 32 by engagement of parts of the other connector with hooks or latches 80, 82 on the housing. The thick diecast housing 32 is provided to withstand the high forces encountered in such connection. The housing 32 is connected to a ground plane 84 on the circuit board by physical contact therewith.

FIG. 4 illustrates a another connector 90, which is similar to that of FIG. 2, with an identical shell 24 and insert device 14. However, the housing 92 is formed with a limit wall 94 that is of simple form in that it merely abuts the leading side portion 52 of the shell flange, but does not lie above it (except at the slots **46*a*, 48*a***).

FIG. 5 illustrates a shell 100 constructed in accordance with another embodiment of the invention, whose flange end portions 102, 104 are formed with integral leaf springs 106, 108. The shell 100 can be used in place of the shells of FIGS. 1 and 4. Each leaf spring such as 106 has an upper location 110 that contacts a housing top slot wall (such as 48*t* of FIG. 3). The flange also has a pair of lower locations 112, 114 that contact a housing bottom slot wall (such as 48*b* of FIG. 3). The use of such flange portions bent in a wave-like manner, which is separated along a cut line 116 extending along the insert direction 118 to form a separate leaf spring 106, makes the wave-like portion more reliable in up-and-down bending.

Thus, the invention provides a connector of the type that includes a thin sheet metal shell such as a drawn shell, which closely receives an insert device, and a thicker metal housing such as a diecast housing, which receives both of them, which facilitates assembly. The housing has a vertical hole for receiving the insert device, and has a pair of slots at opposite ends of the hole for receiving end flange portions of the shell. The shell has a vertical hole, and its flange end portions can be inserted into the housing slots until the holes in the shell and housing are aligned. The insert device is then inserted from below until it is prevented from downward movement by the housing and prevented from horizontal movement by the shell. The flange portions of the shell are deformed in a wave-like manner, to form an interference fit with the walls of the housing slots, to provide good electrical connection therewith.

Although particular embodiments of the invention have been described and illustrated herein, it is recognized that modifications and variations may readily occur to those skilled in the art and consequently it is intended to cover such modifications and equivalents.

What is claimed is:

1. In a connector which includes an insert having an insulative holder and multiple contacts wherein, a sheet metal shell that can closely receive said insert, and a metal housing with thicker walls than said shell and which holds said shell and is electrically connected to it, said housing having opposite ends, opposite sides, and top and bottom portions, the improvement wherein:

said housing is formed of a single piece of material which has a vertical hole for receiving said insert, and has wall forming a pair of largely horizontal slots lying at said opposite ends of said hole;

said shell has a casing portion with a vertical hole that closely receives said insert, and said shell has a pair of largely horizontal flange portions positioned to fit into said housing slots to make electrical connection therewith, said shell being insertable in a largely horizontal direction into said housing with said flange portions entering said slots, until said shell lies in a fully inserted position at which said casing hole is substantially aligned with said housing hole, said slots in said single piece housing extending to a first side of said housing to leave said slots open at said first side of said housing, so said flange portions can be installed by sliding them into said first side of said housing.

2. The improvement described in claim 1 wherein:

said shell flange portions are bent in a largely wave-like manner, each flange portion having at least one continuous undulation forming a top location and a pair of bottom locations on either side of said top location.

3. The improvement described in claim 2 wherein:

said shell flange portions each have a cut that extends along said insert direction, to form a separate leaf spring having said undulation.

4. The improvement described in claim 1 wherein:

said shell has a flange with opposite end portions forming said first mentioned flange portions, said flange also having opposite side portions;

said first side of said housing is open between said slots to receive one of said flange side portions, but the opposite second side of said housing has a limit wall that limits insertion of said shell to a position at which said casing and housing holes are aligned.

5. A connector comprising:

an insert device which includes an insulative holder and multiple contacts therein, said device having upper and lower parts;

a drawn sheet metal shell which includes a casing that has a vertical hole that receives said upper part of said insulative holder, and a primarily horizontally-extending flange extending largely around said casing;

a one-piece cast metal housing having thicker walls than said shell, said housing having a vertical hole through which said upper part of said insert can pass, and a pair of horizontal slots lying about said opening and having top and bottom slot walls and being open at one side of said housing to receive said flange to a position at which said shell hole is aligned with said housing hole and with said flange pressing against said slot walls in electrical connection therewith.

6. The connector described in claim 5 wherein:

said housing and said hole therein each have opposite ends and opposite sides, and said housing includes walls forming said slots at said opposite ends of said housing hole;

said flange has opposite end portions that are each deformed to form a continuous undulation having a top location and a pair of bottom locations on either side of said top location, with the differences in heights between said top location and said pair of bottom locations being greater than the heights and said slots, whereby said flanges press against the walls of said slots to make electrical contact therewith.

7. The connector described in claim 5 wherein:

said housing has a stop at the height of said slots, and lying on a side of said housing hole opposite said first housing side to engage a side of said flange, said stop located to engage said flange when said shell hole is aligned with said housing hole.

8. In the assembly of a connector which includes an insert device with an upper part, a one-piece cast metal housing with opposite sides and with a hole having opposite ends through which said insert upper part can pass, and a sheet metal shell which has a casing with opposite ends and upper and lower parts, and with a largely vertical hole that can closely receive said insert upper part, the improvement comprising:

forming said housing with a pair of largely horizontally-extending slots on opposite ends of said housing hole, with said slots extending to a first side of said housing;

forming said shell with a pair of flange portions extending in opposite directions from opposite ends of the bottom of said casing, and deforming each of said flange portions to have a wave-like configuration of varying height, with the greatest variation of height being greater than the heights of said slots;

inserting said shell flange portions into said slots from said first side of said housing until said shell and housing holes are aligned, and then inserting said insert upper part into said holes.

* * * * *